US009437165B2

(12) United States Patent
Kumar

(10) Patent No.: US 9,437,165 B2
(45) Date of Patent: Sep. 6, 2016

(54) POWER-EFFICIENT CONTROL OF DISPLAY DATA CONFIGURED TO BE RENDERED ON A DISPLAY UNIT OF A DATA PROCESSING DEVICE

(71) Applicant: NVIDIA Corporation, Santa Clara, CA (US)

(72) Inventor: Harsha Kumar, Maharashtra (IN)

(73) Assignee: NVIDIA Corporation, Santa Clara, CA (US)

( * ) Notice: Subject to any disclaimer, the term of this patent is extended or adjusted under 35 U.S.C. 154(b) by 36 days.

(21) Appl. No.: 14/067,966

(22) Filed: Oct. 31, 2013

(65) Prior Publication Data

US 2015/0116294 A1 Apr. 30, 2015

(51) Int. Cl.

| | |
|---|---|
| ***G09G 3/00*** | (2006.01) |
| ***G09G 5/14*** | (2006.01) |
| ***G09G 3/34*** | (2006.01) |

(52) U.S. Cl.

CPC ..... *G09G 5/14* (2013.01); *G09G 3/342* (2013.01); *G09G 2320/0686* (2013.01); *G09G 2330/021* (2013.01)

(58) Field of Classification Search

CPC ..... G09G 5/00

See application file for complete search history.

(56) References Cited

U.S. PATENT DOCUMENTS

| | | | | |
|---|---|---|---|---|
| 5,191,421 | A | 3/1993 | Hwang | |
| 6,002,386 | A | 12/1999 | Gu | |
| 7,580,031 | B2 | 8/2009 | Plut | |
| 7,580,033 | B2 | 8/2009 | Plut | |
| 7,602,408 | B2 | 10/2009 | Plut | |
| 8,368,638 | B2 | 2/2013 | Yun | |
| 2005/0052446 | A1* | 3/2005 | Plut | 345/211 |
| 2013/0050296 | A1* | 2/2013 | Plut | 345/690 |

FOREIGN PATENT DOCUMENTS

| | | |
|---|---|---|
| EP | 2053850 B1 | 6/2011 |
| WO | 9418790 A1 | 8/1994 |

* cited by examiner

*Primary Examiner* — Michael Faragalla
(74) *Attorney, Agent, or Firm* — Zilka-Kotab, PC

(57) ABSTRACT

A method includes scanning, through a processor of a data processing device communicatively coupled to a memory, display data to be rendered on a display unit communicatively coupled to the data processing device for boundaries of one or more virtual object(s) therein. The method also includes rendering, through the processor, a portion of the display data outside the boundaries of the one or more virtual object(s) at a reduced level compared to a portion of the display data within the boundaries on the display unit.

18 Claims, 7 Drawing Sheets

POWER-EFFICIENT CONTROL OF DISPLAY DATA CONFIGURED TO BE RENDERED ON A DISPLAY UNIT OF A DATA PROCESSING DEVICE

FIELD OF TECHNOLOGY

This disclosure relates generally to data processing devices and, more particularly, to a method, a device and/or a system of power-efficient control of display data configured to be rendered on a display unit of a data processing device.

BACKGROUND

A data processing device (e.g., a desktop computer, a laptop computer, a notebook computer, a smart television, a smart display, a netbook, a mobile device such as a mobile phone) may render display data on a display unit (e.g., a Liquid Crystal Display (LCD)) associated therewith. The display unit and a display data processing pipeline within the data processing device may be associated with high power consumption through the data processing device. A user of the data processing device may, therefore, operate the data processing device in a power savings mode thereof, where an intensity of a backlight of the display unit is reduced. The aforementioned power savings mode may provide for poor clarity of the display data. Further, the power savings mode may still be associated with considerable power consumption.

SUMMARY

Disclosed are a method, a device and/or a system of power-efficient control of display data configured to be rendered on a display unit of a data processing device.

In one aspect, a method includes scanning, through a processor of a data processing device communicatively coupled to a memory, display data to be rendered on a display unit communicatively coupled to the data processing device for boundaries of one or more virtual object(s) therein. The method also includes rendering, through the processor, a portion of the display data outside the boundaries of the one or more virtual object(s) at a reduced level compared to a portion of the display data within the boundaries on the display unit.

In another aspect, a non-transitory medium, readable through a data processing device and including instructions embodied therein that are executable through the data processing device, is disclosed. The non-transitory medium includes instructions to scan, through a processor of the data processing device communicatively coupled to a memory, display data to be rendered on a display unit communicatively coupled to the data processing device for boundaries of one or more virtual object(s) therein. The non-transitory medium also includes instructions to render, through the processor, a portion of the display data outside the boundaries of the one or more virtual object(s) at a reduced level compared to a portion of the display data within the boundaries on the display unit.

In yet another aspect, a data processing device includes a memory, and a processor communicatively coupled to the memory. The processor is configured to execute instructions to scan display data to be rendered on a display unit communicatively coupled to the data processing device for boundaries of one or more virtual object(s) therein, and to render a portion of the display data outside the boundaries of the one or more virtual object(s) at a reduced level compared to a portion of the display data within the boundaries on the display unit.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein.

Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Example embodiments, as described below, may be used to provide a method, a device and/or a system of power-efficient control of display data configured to be rendered on a display unit of a data processing device. Although the present embodiments have been described with reference to specific example embodiments, it will be evident that various modifications and changes may be made to these embodiments without departing from the broader spirit and scope of the various embodiments.

Figure 1:
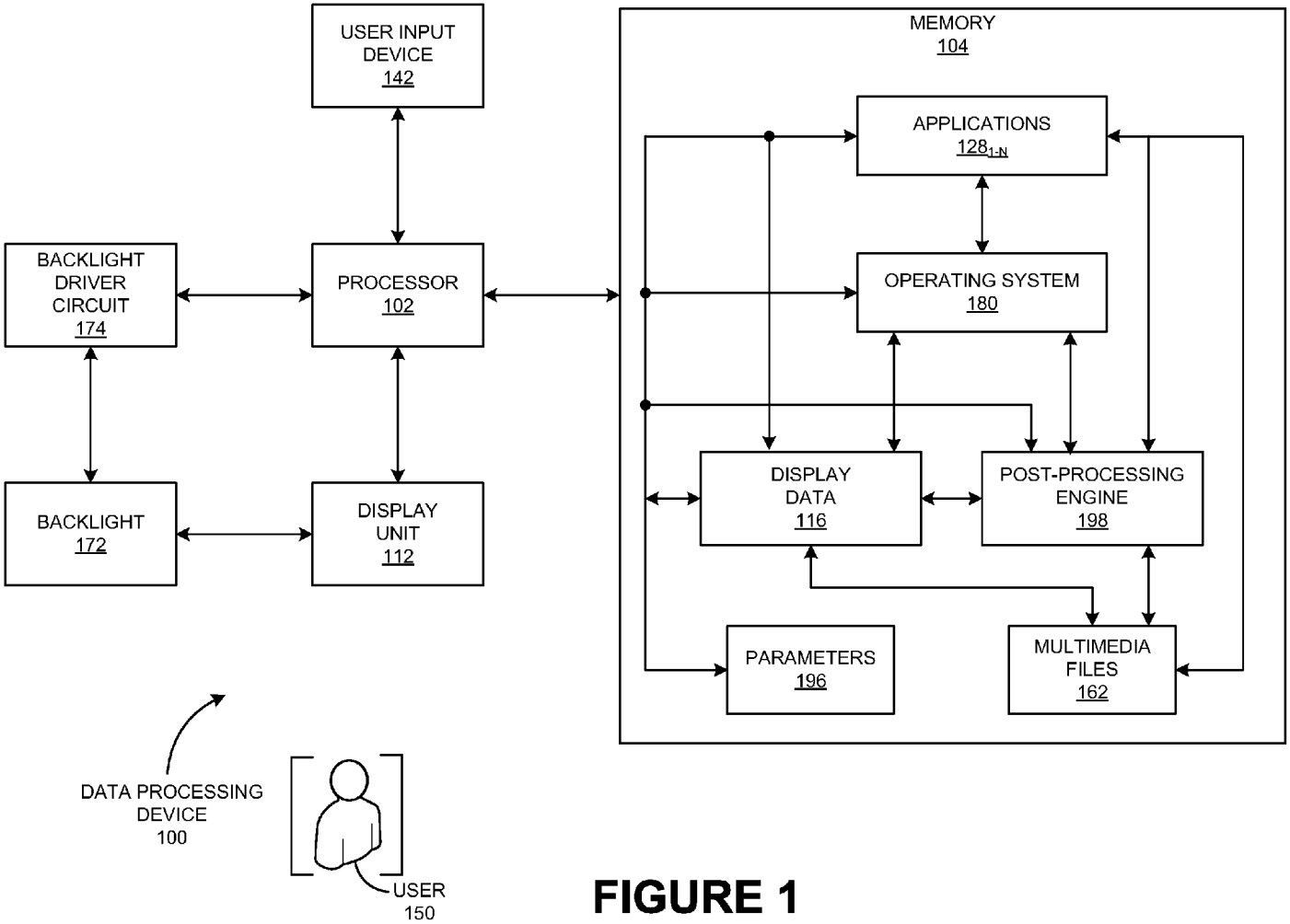
FIG. 1 is a schematic view of a data processing device, according to one or more embodiments.

FIG. 1 shows a data processing device 100, according to one or more embodiments. In one or more embodiments, data processing device 100 may be a laptop computer, a desktop computer, a smart television, a smart display, a notebook computer, a netbook, a tablet or a mobile device such as a mobile phone. Other forms of data processing device 100 are within the scope of the exemplary embodiments discussed herein. In one or more embodiments, data processing device 100 may include a processor 102 (e.g., a Central Processing Unit (CPU), a Graphics Processing Unit (GPU)) communicatively coupled to a memory 104 (e.g., a volatile memory and/or a non-volatile memory); memory 104 may include storage locations configured to be addressable through processor 102.

FIG. 1 shows a display unit 112 (e.g., a Cathode Ray Tube (CRT) display, a Liquid Crystal Display (LCD)) being interfaced with processor 102; processor 102 may be configured to generate display data 116 to be rendered on display unit 112. FIG. 1 shows display data 116 and one or more parameter(s) 196 (e.g., pixel intensity, pixel resolution) thereof being stored in memory 104; memory 104 may also include one or more multimedia file(s) 162 (e.g., text files, video files, audio files, image files) stored therein. In one or more embodiments, data processing device 100 may execute an operating system 180 thereon; again, FIG. 1 shows operating system 180 being stored in memory 104. In one or more embodiments, display unit 112 may include a backlight 172 associated therewith; said backlight 172 may also include a backlight driver circuit 174 thereof, which is shown interfaced with processor 102 in FIG. 1.

Further, in one or more embodiments, one or more application(s) $\mathbf{128}_{1\text{-}N}$ (shown as being stored in memory 104) may execute on data processing device 100. Examples of application(s) $\mathbf{128}_{1\text{-}N}$ may include but are not limited to media players, word processing applications, web browser applications and/or web applications. In one or more embodiments, one of the aforementioned application(s) $\mathbf{128}_{1\text{-}N}$ may be a process configured to execute on data processing device 100 to reduce power consumption associated with display data 116 and/or display unit 112, as will be discussed below. Alternately, the process may be a post-processing engine (e.g., shown as post-processing engine 198 stored in memory 104) configured to execute on processor 102 to provide for reduction of the aforementioned power consumption.

Figure 2:
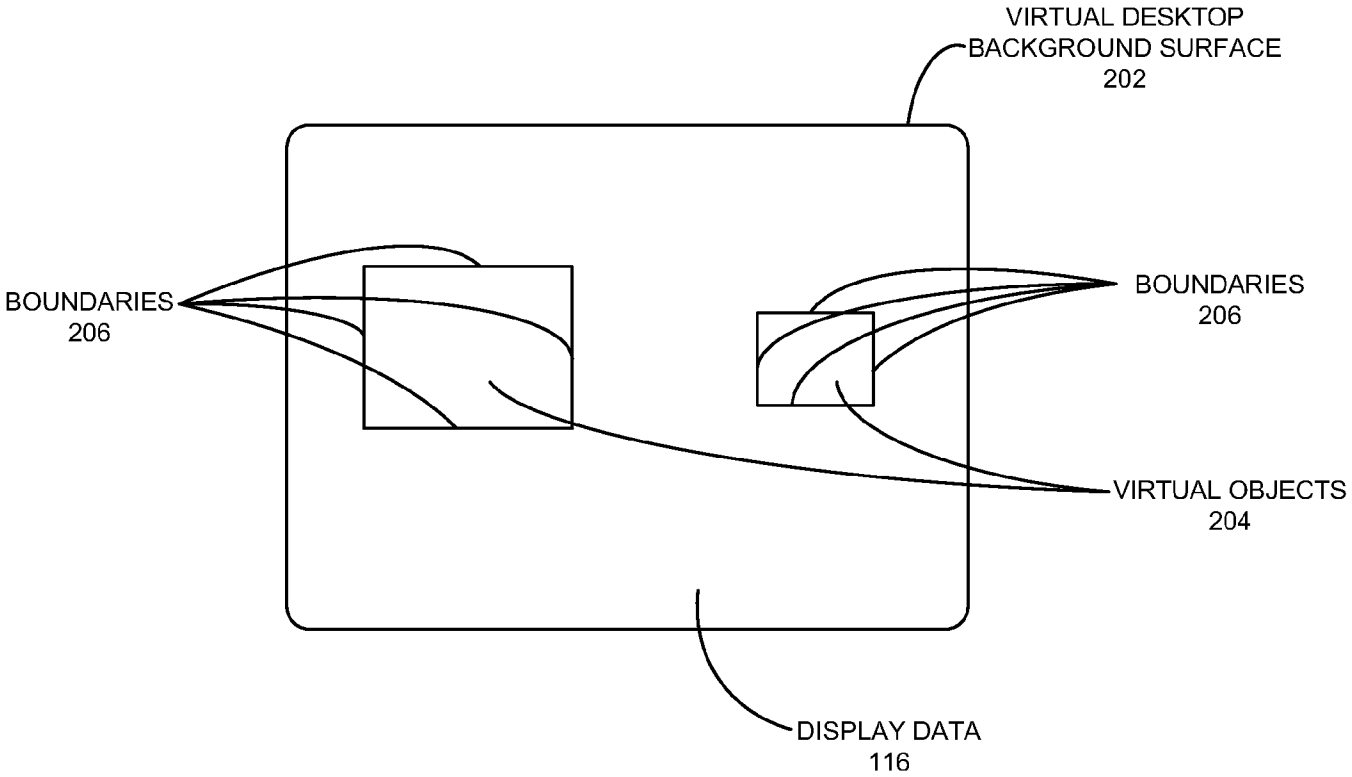
FIG. 2 is an illustrative view of a virtual desktop background surface provided by an operating system executing on the data processing device of FIG. 1 onto which display data is overlaid.

FIG. 2 shows a virtual desktop background surface 202 provided by operating system 180 onto which display data 116 is overlaid. Here, in one or more embodiments, display data 116 may include virtual objects 204 (e.g., desktop icons, windows, user interfaces, multimedia file(s) 162 being rendered directly or through a web browser application/web application) viewable through display unit 112. In one or more embodiments, the spatial location of virtual objects 204 within virtual desktop background surface 202 may be defined through operating system 180. In one or more embodiments, through the execution of the process (e.g., application $\mathbf{128}_{1\text{-}N}$ or post-processing engine 198) discussed above, processor 102 may be configured to detect boundaries (e.g., boundaries 206 in FIG. 2) of virtual objects 204 within virtual desktop background surface 202, following which a level of the one or more parameter(s) 196 (e.g., pixel intensity) of display data 116 and/or an intensity of backlight 172 outside boundaries 206 may be reduced (e.g., reduced in pixel intensity, pixels discarded, backlight 172 outside boundaries 206 turned OFF).

Figure 3:
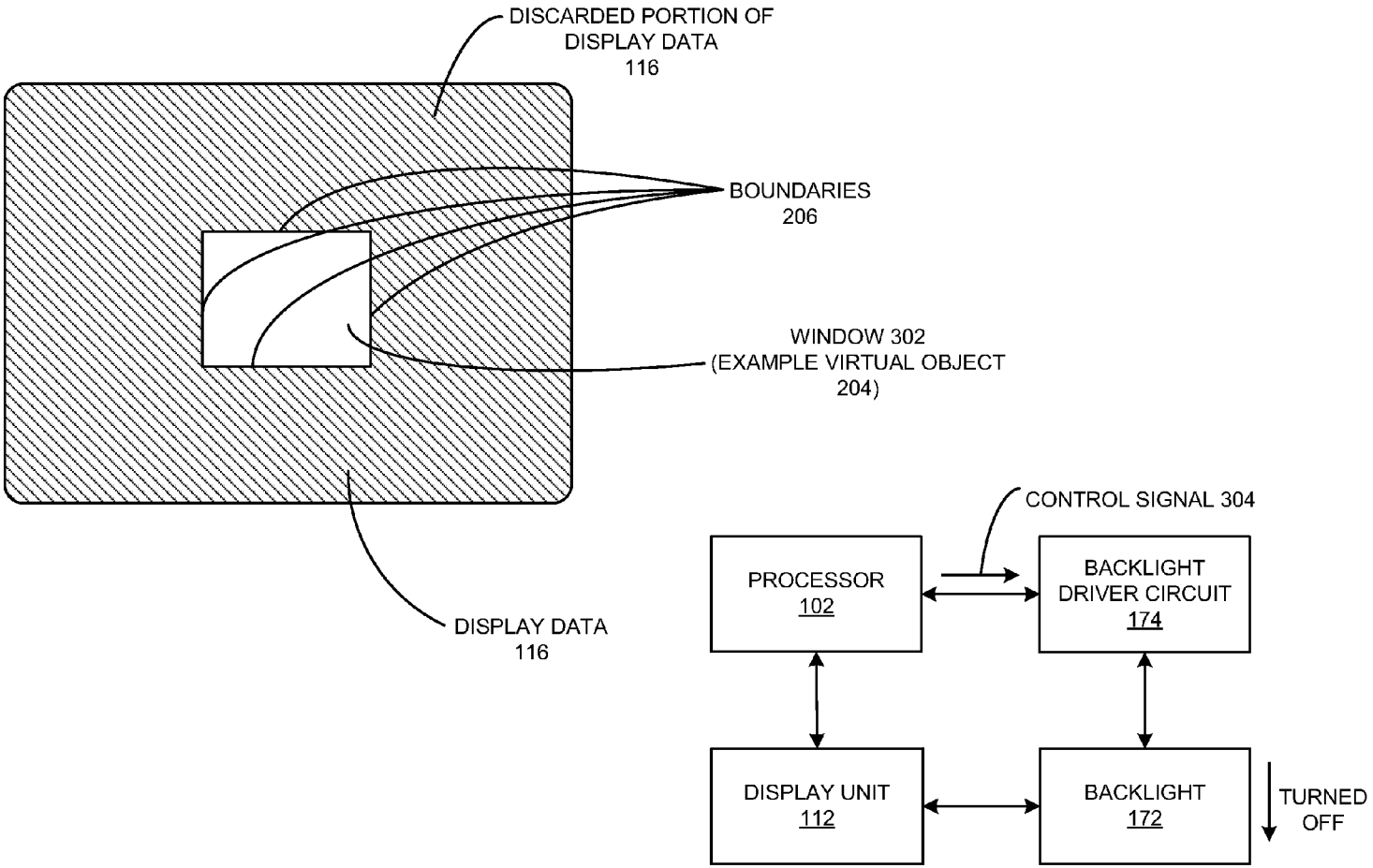
FIG. 3 is an illustrative view of detection of a window as an example virtual object of FIG. 2 within the display data, according to one or more embodiments.

FIG. 3 illustrates the abovementioned process. Here, a window 302 may be an example of virtual object 204. Once processor 102 detects boundaries 206 of window 302 based on information provided through operating system 180, processor 102 may be configured to transmit a control signal 304 to backlight driver circuit 174 to reduce the intensity of backlight 172 outside boundaries 206 and/or reduce a level of the one or more parameter(s) 196 of display data 116 corresponding to a portion thereof outside boundaries 206. FIG. 3 shows display data 116 outside boundaries 206 being discarded and/or backlight 172 corresponding to the portion outside boundaries 206 being switched OFF.

A user 150 (see FIG. 1) of data processing device 100 may concentrate solely on window 302 while viewing display unit 112. Thus exemplary embodiments may provide a means to reduce power consumption in data processing device 100 through "dimming" portions of display data 116 that are "out of focus" with respect to user 150 and/or through dimming backlight 172.

Additionally, in one or more embodiments, an application $\mathbf{128}_{1\text{-}N}$ and/or post-processing engine 198 may include instructions (e.g., configured to execute on processor 102) to scan display data 116 and/or a web browser application (another application $\mathbf{128}_{1\text{-}N}$) for three-dimensional (3D) content therein, and then cause the dimming of display data 116 and/or backlight 172 outside the boundaries of the 3D content. In yet another example, display data 116 onscreen or within the web browser application may be scanned for video data content, based on which processor 102 may execute instructions to enable dimming of display data 116 and/or backlight 172 outside the boundaries of the video data content.

Figure 4:
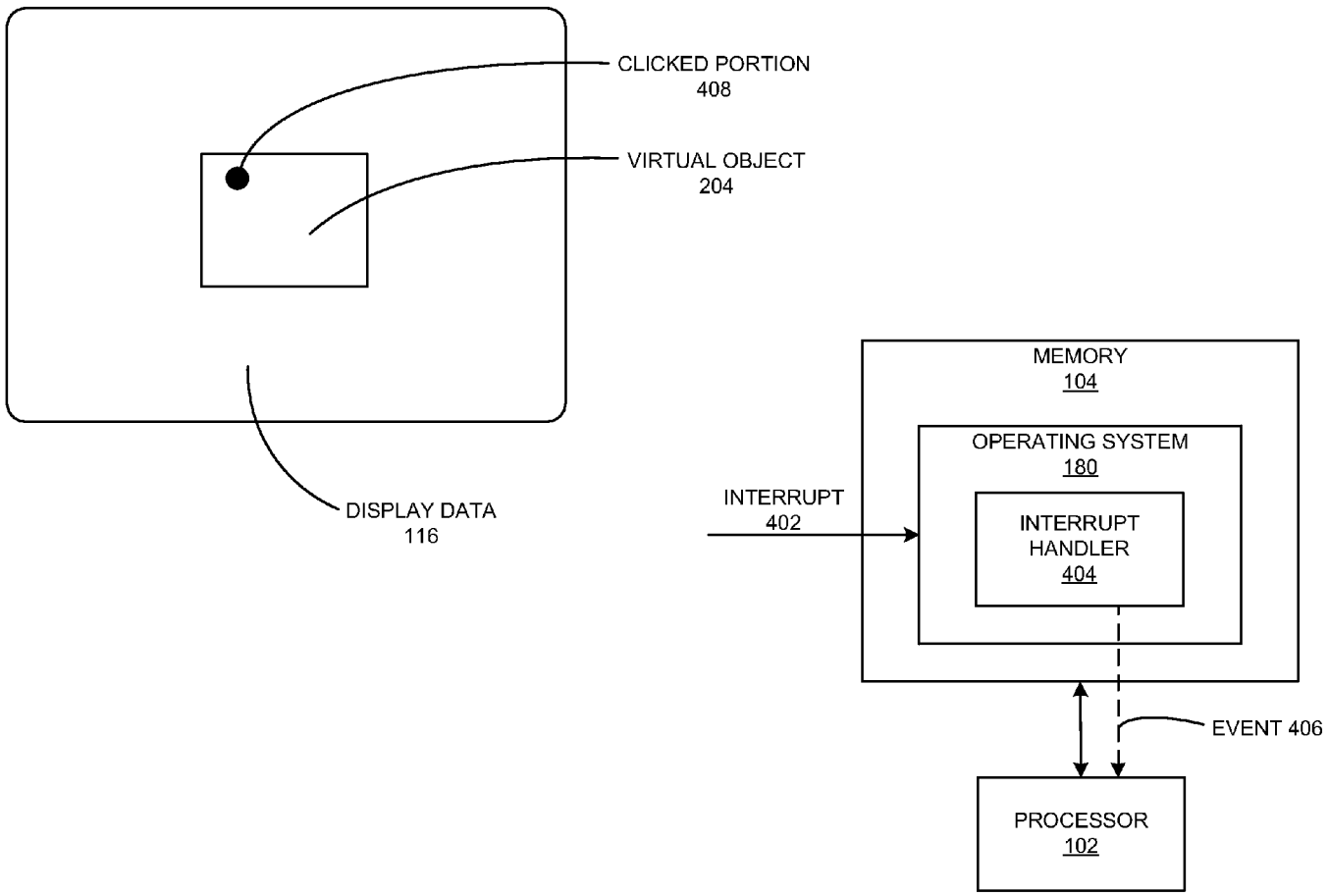
FIG. 4 is an illustrative view of a sequence of events associated with clicking a portion of the display data.

Referring back to FIG. 1, data processing device 100 may include a user input device 142 (e.g., a keyboard, a keypad, a mouse, a trackball) associated therewith. FIG. 1 shows user input device 142 interfaced with processor 102. In one or more embodiments, user 150 may click on (or, select) a portion of display data 116 onscreen or within a web browser application through user input device 142. FIG. 4 illustrates a sequence of events associated with the aforementioned clicking. As shown in FIG. 4, the clicking of the portion of display data 116 may generate an interrupt 402 to operating system 180. Application $\mathbf{128}_{1\text{-}N}$ and/or operating system 180 may include an interrupt handler 404 to handle said interrupt 402; FIG. 4 shows operating system 180 as including interrupt handler 404 implemented therein. Following the handling of interrupt 402, operating system 180 may be configured to generate an event 406 interpretable through processor 102.

In one or more embodiments, once processor 102 interprets event 406, processor 102 may be configured to detect boundaries 206 of virtual objects 204 discussed above around the clicked portion (e.g., clicked portion 408) of display data 116. Thus, in one or more embodiments, the search space for processor 102 may be reduced because of the searching/scanning being conducted around clicked portion 408.

Figure 5:
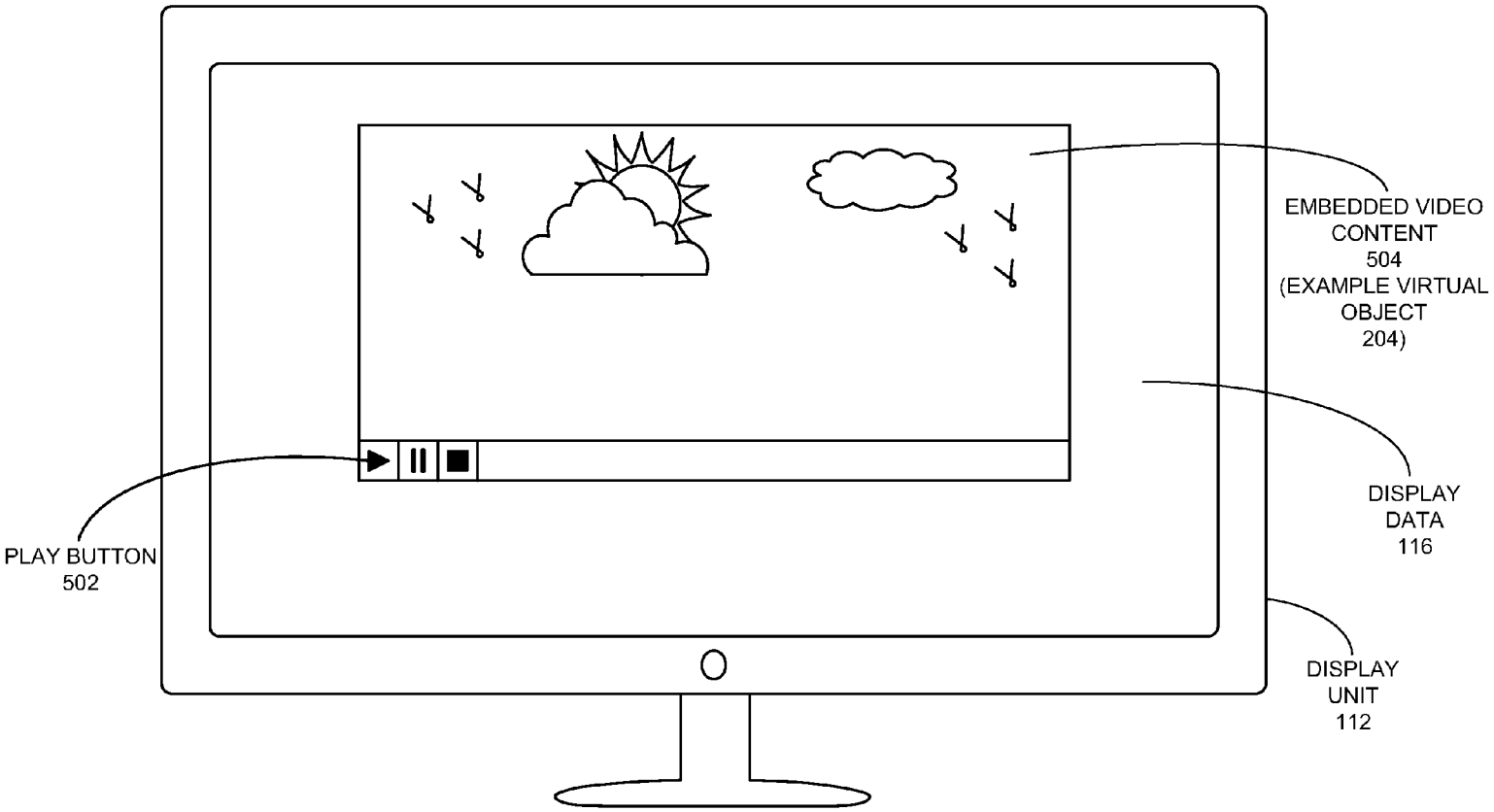
FIG. 5 is an illustrative view of an example clicked portion of the display data viewable through a display unit of the data processing device of FIG. 1.

FIG. 5 shows an example clicked portion 408 of display data 116 viewable through display unit 112. User 150 may click a play button 502 of an embedded video content 504 within a web browser application 504. Here, processor 102 may scan around play button 502 to determine boundaries 206 of embedded video content 504 (example virtual object 204) in order to dim display data 116 and/or backlight 172 around embedded video content 504. It should be noted that the dimming may proceed for a duration of video data associated with embedded video content 504.

In another example, user 150 may click a search option from a menu associated with content within web browser application 504. Here, processor 102 may determine clicked portion 408 and highlight the search option in contrast to other portions of display data 116. All reasonable variations are within the scope of the exemplary embodiments discussed herein.

In yet another example, processor 102 may determine successive clicking events (e.g., event 406). Based on the determination, processor 102 may perform a modification of virtual object 204 and boundaries 206 thereof. For example, user 150 may first click (example input) a video content, following which user 150 may read text data below the video content based on initiation thereof through another click through user input device 142. Now, as the region of display data 116 associated with clicked portion 408 changes, virtual object 204 and boundaries 206 thereof also may change. Processor 102 may dynamically modify the portions of display data 116 outside boundaries 206 that are to be rendered at a level lower than that of the portions within boundaries 206. In an alternate implementation, the dimming may proceed for a default time duration (e.g., predefined) following event 406.

In one or more embodiments, the detection of virtual objects 204 and boundaries 206 thereof and/or the dynamic modification of the one or more parameter(s) 196 of display data 116 and/or the intensity of backlight 172 may be triggered through a driver component (e.g., a set of instructions) associated with processor 102 and/or display unit 112. In one or more embodiments, the driver component may be packaged with one or more application(s) $\mathbf{128}_{1\text{-}N}$ and/or operating system 180. Additionally, instructions associated with the driver component and/or the one or more application(s) $\mathbf{128}_{1\text{-}N}$ may be embodied in a non-transitory medium (e.g., a Compact Disc (CD), a Digital Video Disc (DVD), a Blu-ray Disc®, a hard drive; appropriate instructions may be downloaded to the hard drive) readable through data processing device 100 and executable therethrough.

Figure 6:
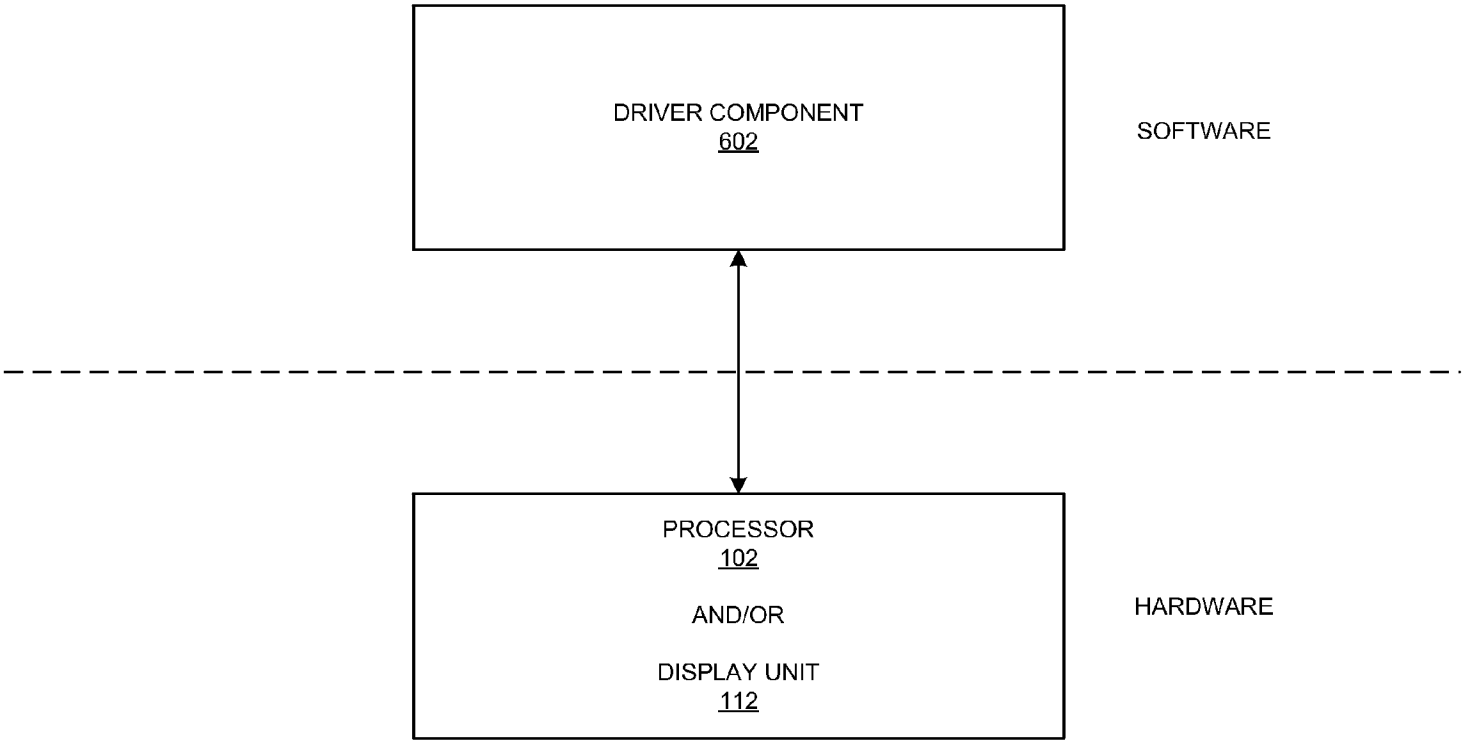
FIG. 6 is a schematic view of interaction between a driver component and a processor and/or the display unit of the data processing device of FIG. 1, according to one or more embodiments.

FIG. 6 shows interaction between a driver component 602 and processor 102 and/or display unit 112, according to one or more embodiments. In one or more embodiments, as discussed above, driver component 602 may be configured to trigger, through processor 102 (based on execution of an application $\mathbf{128}_{1\text{-}N}$ and/or post-processing engine 198), detection of boundaries 206 of one or more virtual objects 204 (it is obvious that boundaries 206 of more than one virtual object 204 may be detected) within display data 116 and/or the dynamic modification of one or more parameter (s) 196 of display data 116 outside boundaries 206 and/or the intensity of backlight 172 outside boundaries 206 such that the portions outside boundaries 206 are rendered at a reduced level compared to portions within boundaries 206.

In one or more embodiments, the abovementioned reduction of levels outside boundaries 206 may provide for considerable power savings with regard to data processing device 100 because the display pipeline within processor 102 and/or display unit 112 is associated with high power consumption.

Figure 7:
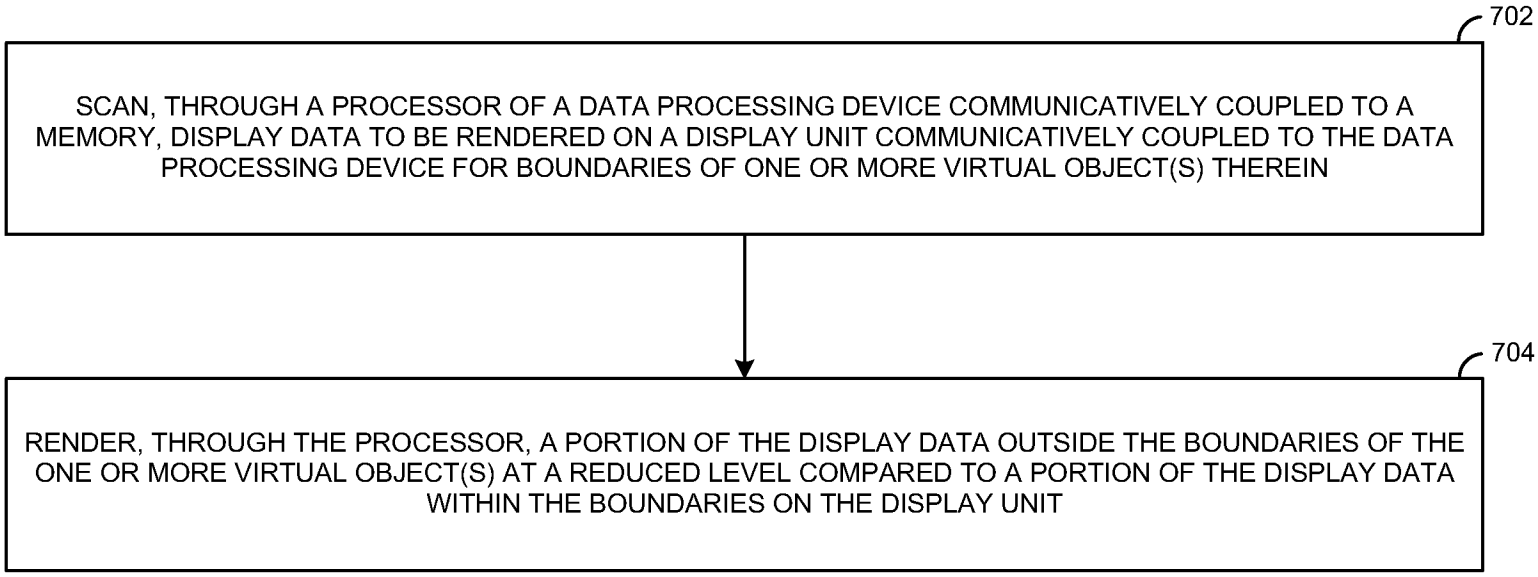
FIG. 7 is a process flow diagram detailing the operations involved in power-efficient control of the display data configured to be rendered on the display unit of the data processing device of FIG. 1, according to one or more embodiments.

FIG. 7 shows a process flow diagram detailing the operations involved in a power-efficient control of display data 116, according to one or more embodiments. In one or more embodiments, operation 702 may involve scanning, through processor 102 of data processing device 100, display data 116 to be rendered on display unit 112 for boundaries 206 of one or more virtual object(s) 204 therein. In one or more embodiments, operation 704 may then involve rendering, through processor 102, a portion of display data 116 outside boundaries 206 of the one or more virtual object(s) 204 at a reduced level compared to a portion of display data 116 within boundaries 206 on display unit 112.

Although the present embodiments have been described with reference to specific example embodiments, it will be evident that various modifications and changes may be made to these embodiments without departing from the broader spirit and scope of the various embodiments. For example, the various devices and modules described herein may be enabled and operated using hardware circuitry (e.g., CMOS based logic circuitry), firmware, software or any combination of hardware, firmware, and software (e.g., embodied in a non-transitory machine-readable medium). For example, the various electrical structures and methods may be embodied using transistors, logic gates, and electrical circuits (e.g., application specific integrated (ASIC) circuitry and/or Digital Signal Processor (DSP) circuitry).

In addition, it will be appreciated that the various operations, processes and methods disclosed herein may be embodied in a non-transitory machine-readable medium and/or a machine-accessible medium compatible with a data processing system (e.g., data processing device 100). Accordingly, the specification and drawings are to be regarded in an illustrative rather than a restrictive sense.

What is claimed is:

1. A method comprising:

scanning, through a processor of a data processing device communicatively coupled to a memory, display data to be rendered on a display unit communicatively coupled to the data processing device for boundaries of playable video content therein;

detecting, by the processor, a command to play the video content on the display unit; and in response to detecting the command, rendering, through the processor, a portion of the display data outside the boundaries of the video content at a reduced level compared to a portion of the display data within the boundaries on the display unit;

wherein the rendering of the portion of the display data outside the boundaries of the video content at the reduced level is performed for a duration that the video content is played on the display unit.

2. The method of claim 1, further comprising leveraging a virtual desktop background surface on which the display data is overlaid and a definition of a spatial position of the video content within the virtual desktop background surface provided through an operating system executing on the data processing device during determination of the boundaries of the video content.

3. The method of claim 1, wherein rendering the portion of the display data outside the boundaries at the reduced level further comprises at least one of: modifying at least one parameter associated with the display data corresponding to the portion outside the boundaries; and reducing an intensity level of a backlight of the display unit for the portion outside the boundaries.

4. The method of claim 3, further comprising transmitting, through the processor, a control signal to a backlight driver circuit of the backlight to enable reduction of the intensity level thereof.

5. The method of claim 1, further comprising:

triggering at least one of: the scanning of the display data and the rendering of the portion of the display data outside the boundaries at the reduced level through a driver component associated with at least one of the processor and the display unit.

6. The method of claim 5, further comprising providing the driver component packaged with at least one of: an operating system executing on the data processing device and an application executing on the data processing device.

7. A non-transitory medium, readable through a data processing device and including instructions embodied therein that are executable through the data processing device, comprising:

instructions to scan, through a processor of the data processing device communicatively coupled to a memory, display data to be rendered on a display unit communicatively coupled to the data processing device for boundaries of playable video content therein;

detecting, by the processor, a command to play the video content on the display unit; and instructions responsive to detecting the command to render, through the processor, a portion of the display data outside the boundaries of the video content at a reduced level compared to a portion of the display data within the boundaries on the display unit;

wherein the rendering of the portion of the display data outside the boundaries of the video content at the reduced level is performed for a duration that the video content is played on the display unit.

8. The non-transitory medium of claim 7, further comprising instructions to leverage a virtual desktop background surface on which the display data is overlaid and a definition of a spatial position of the video content within the virtual desktop background surface provided through an operating system executing on the data processing device during determination of the boundaries of the video content.

9. The non-transitory medium of claim 7, wherein the instructions to render the portion of the display data outside the boundaries at the reduced level further comprise instructions to at least one of: modify at least one parameter associated with the display data corresponding to the portion outside the boundaries; and reduce an intensity level of a backlight of the display unit for the portion outside the boundaries.

10. The non-transitory medium of claim 9, further comprising instructions to transmit, through the processor, a control signal to a backlight driver circuit of the backlight to enable reduction of the intensity level thereof.

11. The non-transitory medium of claim 7, further comprising instructions to:

trigger at least one of: the scanning of the display data and the rendering of the portion of the display data outside the boundaries at the reduced level through a driver component associated with at least one of the processor and the display unit.

12. A data processing device comprising:

a memory; and a processor communicatively coupled to the memory, the processor being configured to execute instructions to:

scan display data to be rendered on a display unit communicatively coupled to the data processing device for boundaries of playable video content therein, detect a command to play the video content on the display unit; and in response to detecting the command, render a portion of the display data outside the boundaries of the video content at a reduced level compared to a portion of the display data within the boundaries on the display unit;

wherein the rendering of the portion of the display data outside the boundaries of the video content at the reduced level is performed for a duration that the video content is played on the display unit.

13. The data processing device of claim 12, wherein the processor is further configured to execute instructions to leverage a virtual desktop background surface on which the display data is overlaid and a definition of a spatial position of the video content within the virtual desktop background surface provided through an operating system executing on the data processing device during determination of the boundaries of the video content.

14. The data processing device of claim 12, wherein the processor is configured to render the portion of the display data outside the boundaries at the reduced level based on at least one of: modifying at least one parameter associated with the display data corresponding to the portion outside the boundaries, and reducing an intensity level of a backlight of the display unit for the portion outside the boundaries.

15. The data processing device of claim 14, wherein the processor is further configured to execute instructions to transmit a control signal to a backlight driver circuit of the backlight to enable reduction of the intensity level thereof.

16. The data processing device of claim 12, wherein the data processing device further comprises a driver component associated with at least one of the processor and the display unit to trigger at least one of: the scanning of the display data and the rendering of the portion of the display data outside the boundaries at the reduced level.

17. The data processing device of claim 16, wherein the driver component is provided packaged with at least one of: an operating system executing on the data processing device and an application executing on the data processing device.

18. The method of claim 1, wherein the command is detected responsive to selection by a user of the data processing device of an option displayed on the display unit to play the video content.

* * * * *